US007867036B2

(12) United States Patent
Ooi

(10) Patent No.: US 7,867,036 B2
(45) Date of Patent: Jan. 11, 2011

(54) PLUG CONVERTER FOR CHANGING THE ELECTRICAL PIN CONFIGURATION OF AN APPLIANCE PLUG

(75) Inventor: Bee Chuan James Ooi, Kowloon (HK)

(73) Assignee: Sandal PLC (GB)

( * ) Notice: Subject to any disclaimer, the term of this patent is extended or adjusted under 35 U.S.C. 154(b) by 0 days.

(21) Appl. No.: 12/084,945

(22) PCT Filed: Nov. 16, 2006

(86) PCT No.: PCT/GB2006/004296

§ 371 (c)(1),
(2), (4) Date: Jun. 2, 2009

(87) PCT Pub. No.: WO2007/057683

PCT Pub. Date: May 24, 2007

(65) Prior Publication Data

US 2009/0325422 A1 Dec. 31, 2009

(30) Foreign Application Priority Data

Nov. 16, 2005 (GB) ..... 0523344.0

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/00*** | (2006.01) |

(52) U.S. Cl. ..... 439/638

(58) Field of Classification Search ..... 439/638, 439/467, 595, 596, 218, 52, 53, 166, 170, 439/171, 173–175

See application file for complete search history.

(56) References Cited

U.S. PATENT DOCUMENTS

| | | | | |
|---|---|---|---|---|
| 5,033,976 | A | 7/1991 | Sarian et al. | 439/467 |
| 6,749,451 | B2 * | 6/2004 | Schmitt | 439/218 |
| 6,843,669 | B2 * | 1/2005 | Drane et al. | 439/142 |

FOREIGN PATENT DOCUMENTS

| | | |
|---|---|---|
| DE | 1 153 432 | 8/1963 |
| EP | 1 257 018 | 11/2002 |
| EP | 1 467 448 | 10/2004 |

* cited by examiner

*Primary Examiner*—Javaid Nasri
(74) *Attorney, Agent, or Firm*—Renner Kenner Greive Bobak Taylor & Weber

(57) ABSTRACT

A plug converter for changing the electrical pin configuration of an appliance plug has an enclosure with a base and a cover. On the base are connector pins having a first electrical pin configuration for connecting the enclosure to an electrical outlet. Within the enclosure are electrical connectors for connection with an appliance plug having a second electrical pin configuration. The electrical connectors are electrically connected to the connector pins. A support structure is provided adjacent an opening in the enclosure for supporting an appliance plug connected with the electrical connectors.

14 Claims, 5 Drawing Sheets

PLUG CONVERTER FOR CHANGING THE ELECTRICAL PIN CONFIGURATION OF AN APPLIANCE PLUG

CROSS-REFERENCE TO RELATED APPLICATION

This is a §371 application of International patent application number PCT/GB2006/004296 filed Nov. 16, 2006, which claims priority of Great Britain patent application number 0523344.0 filed on Nov. 16, 2005, and which is incorporated herein by reference.

FIELD OF THE INVENTION

The current invention relates to plug converters used to change the electrical pin configuration of an appliance plug. In particular, the invention relates to such a converter for changing the two round pin European plug configuration to the two or three square pin United Kingdom plug configuration commonly used in Hong Kong.

BACKGROUND OF THE INVENTION

Different countries and regions use different electrical plug pin configurations. For example, Australia uses two angled flat pins, the United States uses two parallel flat pins, Europe uses two round pins and the United Kingdom (UK) uses three square pins. Plug converters, sometimes called travel adaptors, for changing the electrical pin configuration of an appliance plug are well known.

Hong Kong has largely adopted the square pin UK configuration for electrical wall outlets, but it is not uncommon for appliances sold in Hong Kong to have a round pin European style plug. Thus, the use of so called Euro plug adaptors is common place in many Hong Kong homes and offices.

Plug converters consist of body having on one part or side a set of pins of a first pin configuration and on a second part or side an electrical socket connected to the pings for receiving a plug having a different pin configuration.

Problems with plug converters are that they cause the plug to protrude a greater distance from the wall outlet, and the weight of the plug body and appliance cord cause the plug to loosen in, or fall out of, the plug converter socket.

SUMMARY OF THE INVENTION

It is an object of the present invention to overcome or substantially ameliorate at least the later problem. More generally it is an object of the present invention to provide a plug converter that supports the appliance plug to prevent it from loosening in or fall out of the converter socket connectors.

In accordance with the above object there is disclosed herein a plug converter for changing the electrical pin configuration of an appliance plug, comprising

- an enclosure comprising a base, a cover for the base, and connector pins having a first electrical pin configuration on the base for connecting the enclosure to an electrical outlet,
- electrical connectors within the enclosure for connection with conducting portions of pins an appliance plug having a second electrical pin configuration, the electrical connectors being connected with the connector pins of the converter,
- the enclosure having a pin retention means arranged to retain the conducting portions of the pins of the appliance plug.

Preferably, the first electrical pin configuration is a three pin United Kingdom configuration.

Preferably, the second electrical configuration is a two pin European configuration.

Preferably, the converter comprises an opening in the enclosure and a support structure adjacent the opening for supporting an appliance plug connected with the electrical connectors, the support structure comprising first and second parts on the base and cover respectively that embrace a part of an appliance plug.

Preferably, the first and second parts comprise surfaces and/or ribs shaped to embrace a part of an appliance plug.

Preferably, the first part is a contoured surface and the second part is shaped ribs.

Preferably, the cover and base are jointed by a hinge.

Preferably, the case and cover pivot open about the hinge for connection of the electrical connectors with an appliance plug.

Further aspects of the invention will become apparent from the following description.

BRIEF DESCRIPTION OF THE DRAWINGS

A preferred form of the present invention will now be described by way of example only and with reference to the accompanying drawings in which.

DETAILED DESCRIPTION OF THE INVENTION

Figure 1:
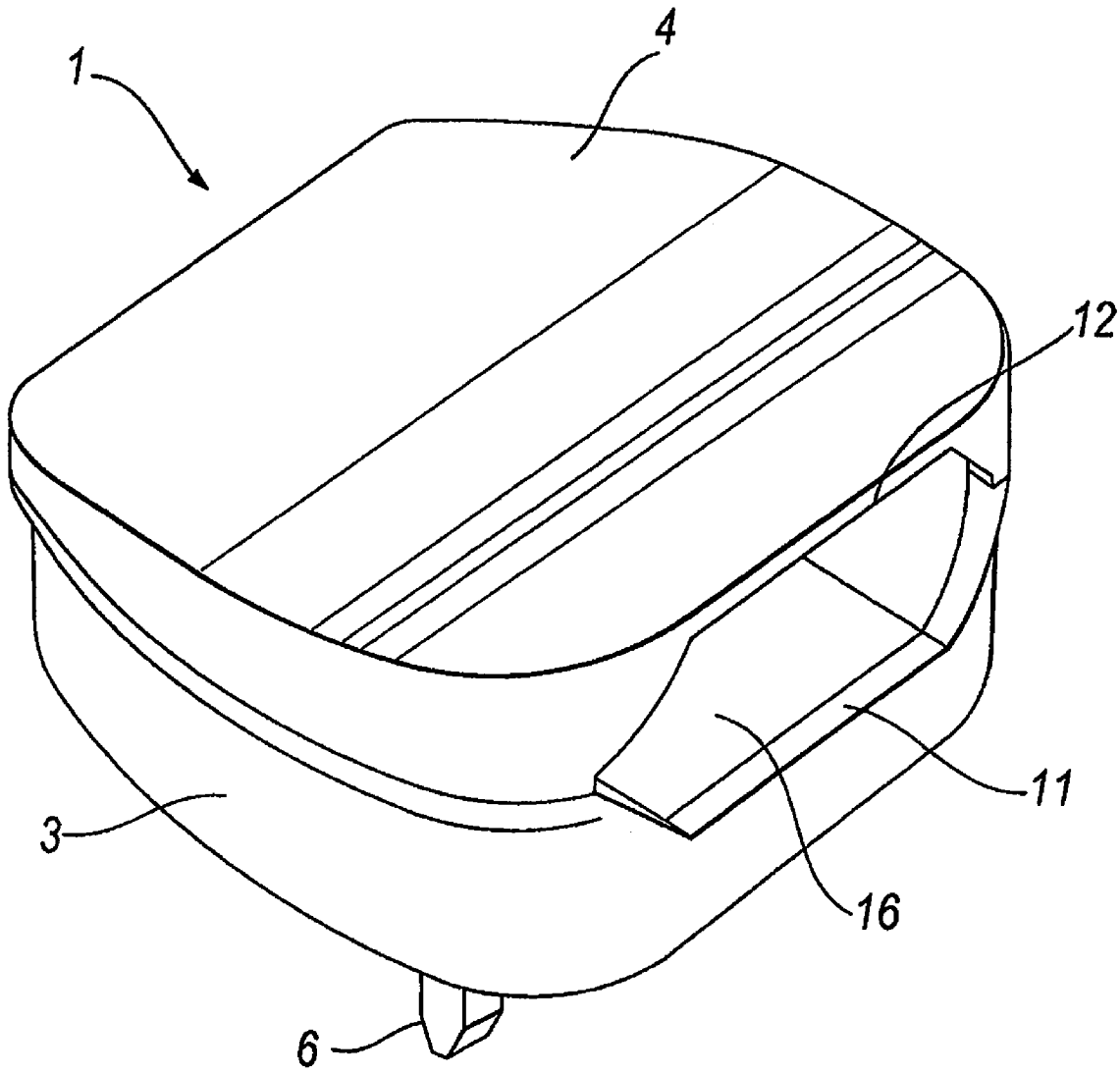
FIG. 1 is a perspective illustration of a plug converter according to the invention.
Figure 1A:
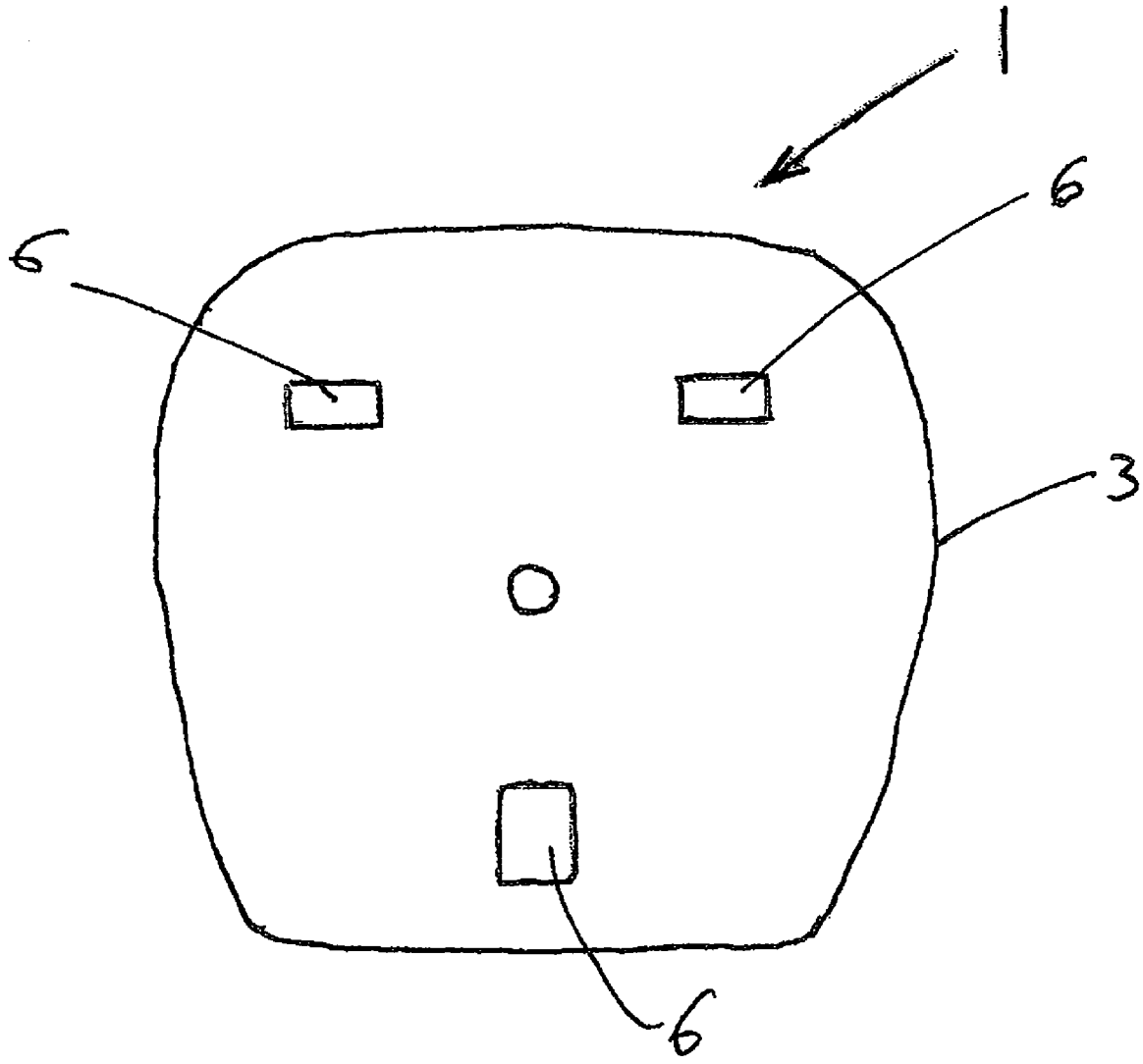
FIG. 1A is a rear elevational view of the plug converter.

In the drawings there is depicted a plug converter 1 for changing the electrical pin configuration of a European type CEE7 (XVI) appliance plug 2. It will be appreciated that other shapes of European plugs may be used. The converter has an enclosure comprising a base 3 and a cover 4 jointed at a hinge 5 along one edge. The edges of the base 3 and cover 4 opposite the hinge 5 have concave wall positions 11,12 forming an opening in the enclosure. The cover is secured shut onto the base by a single 3.10 mm diameter screw. The base 3, hinge 5 and cover 4 are made of plastic by molding in one piece as is well known in the art.

On the base 3 are three square connector pins 6 having a UK configuration for connecting the converter 1 to a UK type electrical outlet (not shown). Molded with the base so as to be within the enclosure are two brackets 7,8 for supporting electrical connectors 9,10 that incorporate a lug shaped to receive round pins 14,15 of the European appliance plug 2. The electrical connectors 9,10 are metallic and are electrically connected to respective connector pins 6. The connectors 9,10 are preferably formed of resilient material such that conducting portions of the pins 14,15 can be pushed into the connectors and retained by the spring force.

Figure 2:
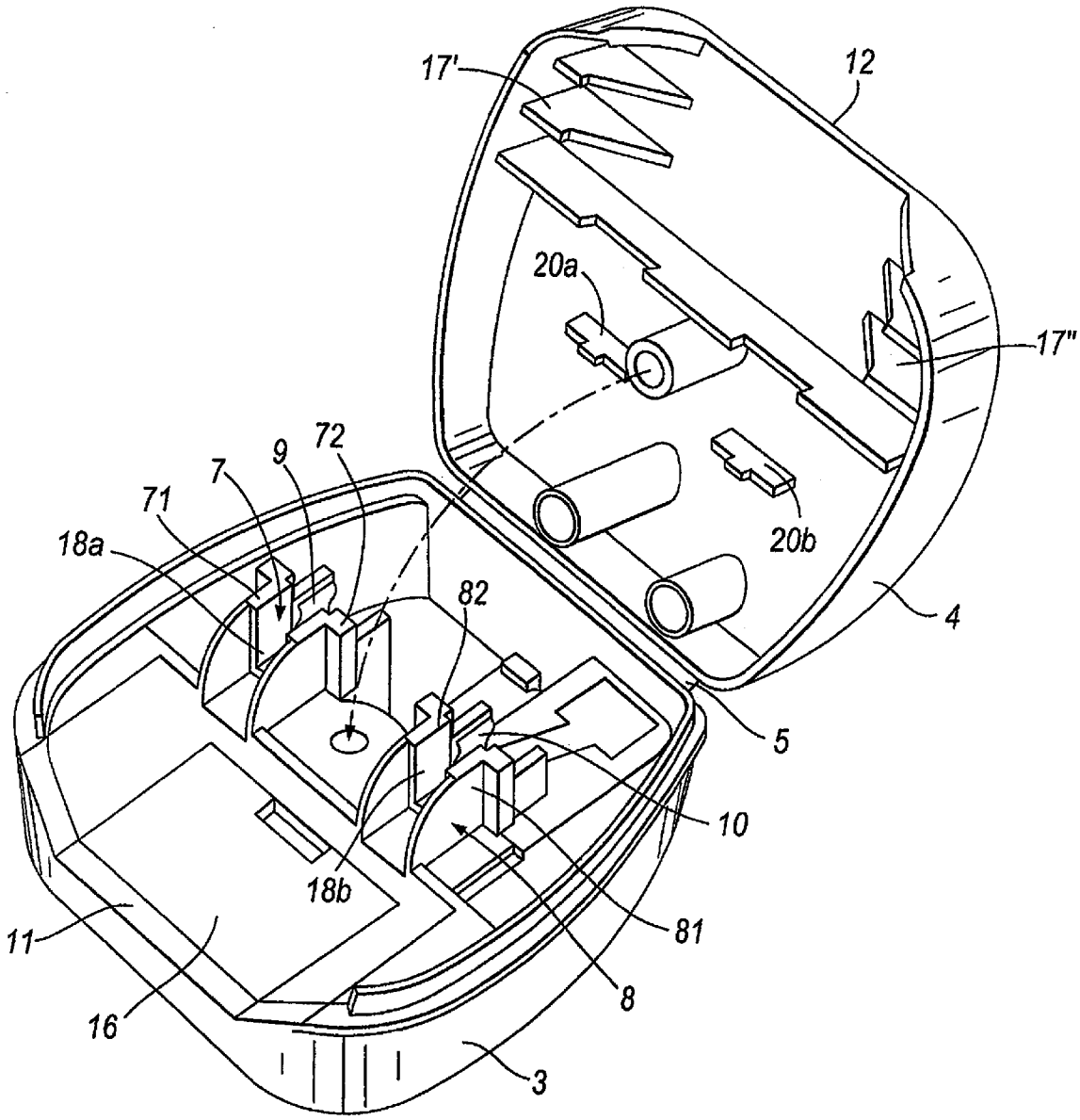
FIG. 2 is a perspective illustration of the plug converter with cover open.
Figure 3:
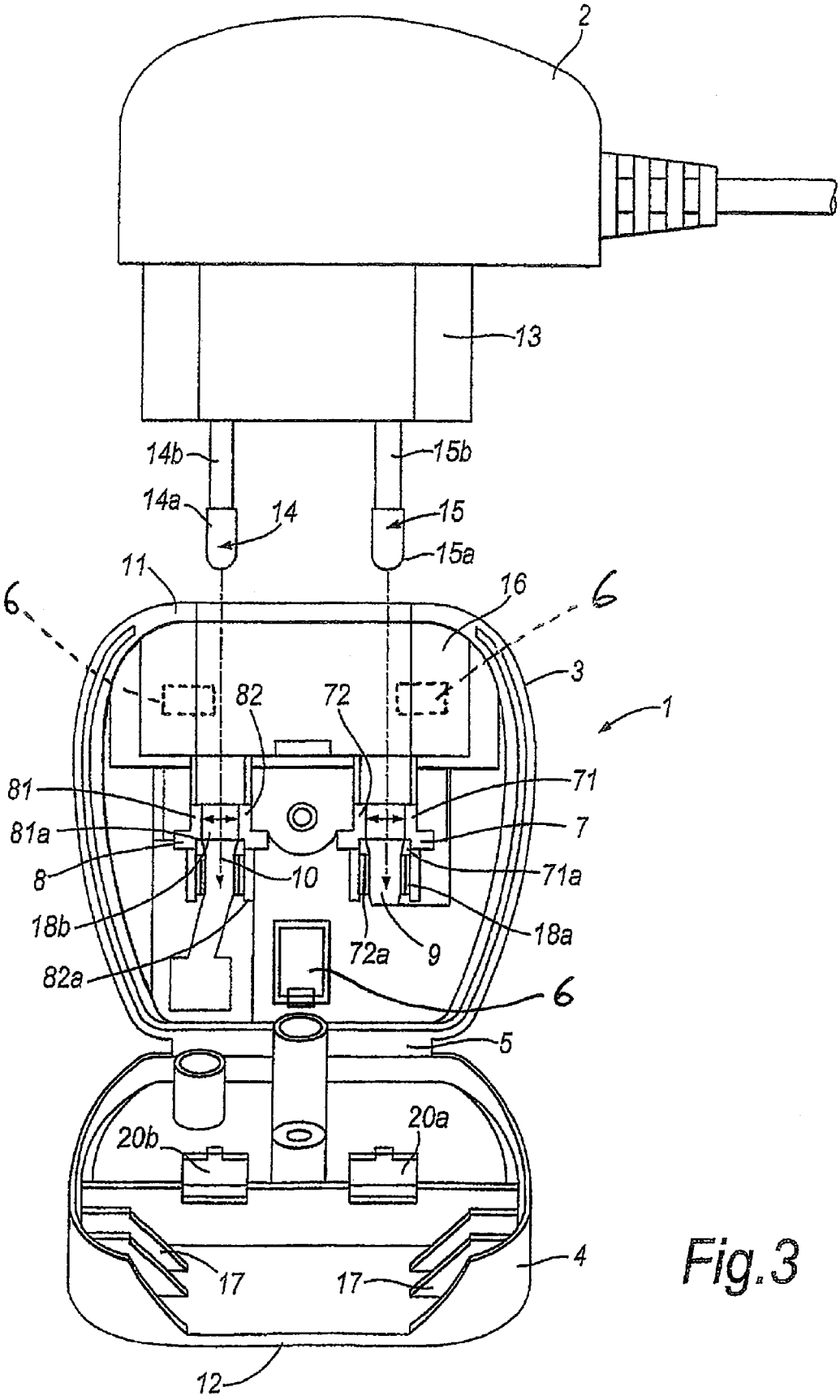
FIG. 3 is an illustration of the converter and an appliance plug.

The brackets will be described in more detail with particular reference to FIGS. 2 to 4. The brackets 7,8 are provided on the base 3 and extend up from the base 3. Bracket 7 comprises a pair of side walls 71,72 spaced from each other to form a channel 18*a*. Bracket 8 is similar in this respect in that it also comprises a pair of side walls 81,82 spaced from each other to form channel 18*b*. The width of each respective channel 18*a*,18*b* can thus be determined by the distance between each respective pair of side walls.

The width of each channel 8*a*, 8*b* is not the same throughout its length and is narrower in a middle portion as shown by "W". This is preferably achieved by making the thickness of the sidewalls greater in this portion than at the end portion. This reduces the width of the channel and creates a U-shaped guide. The size of the width W is chosen such that it is smaller than conducting portions 14*a*,15*a* of the electrical pins 14,15 of a plug 2 which are to be received by the converter 1 but substantially the same or larger than the insulating portions 14*b*,15*b* of the electrical pins 14,15 such that the portions 14*b*,15*b* fit in the middle portion of the brackets 7,8.

Figure 4:
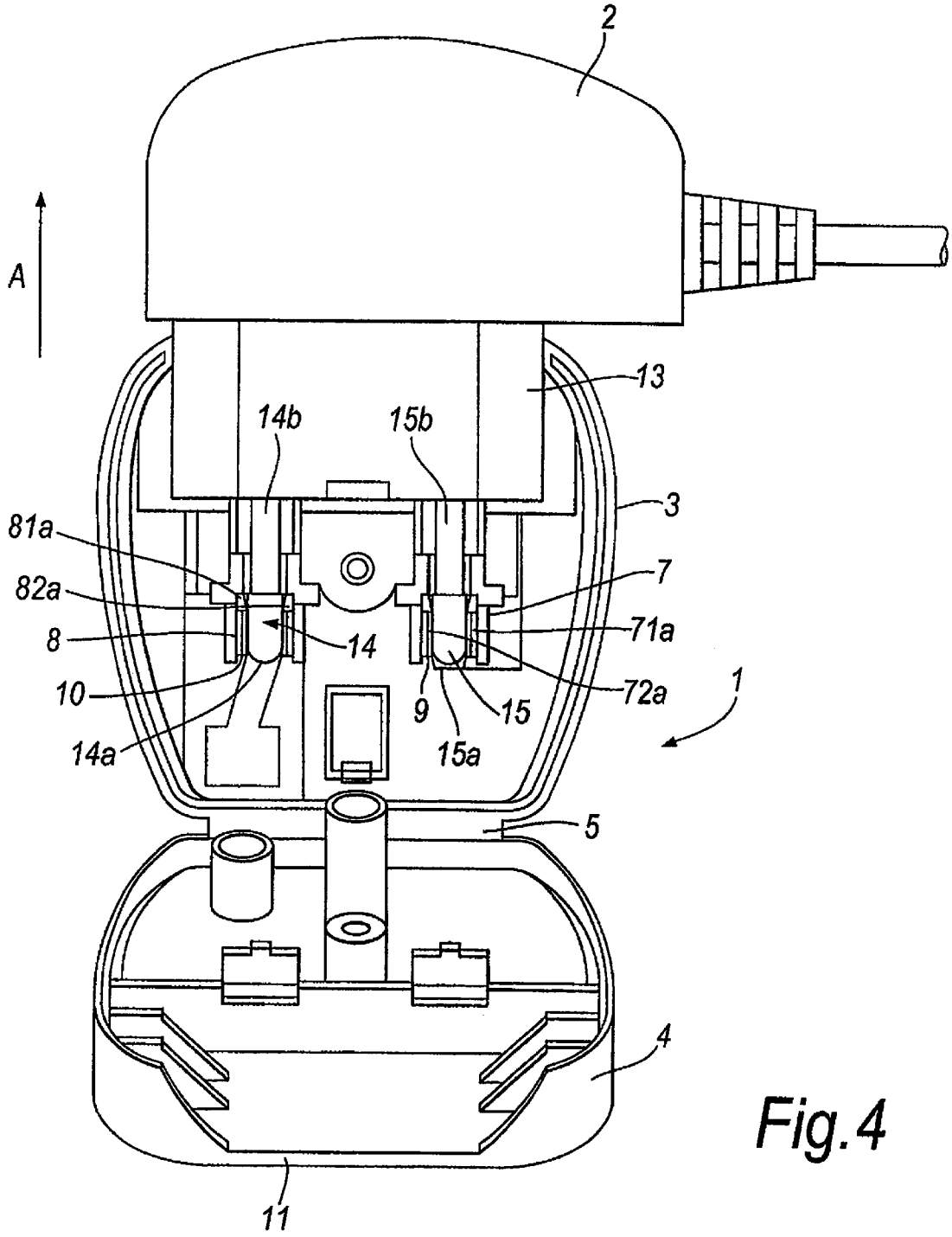
FIG. 4 is an illustration of the plug converter engaged with the appliance plug.

As shown more clearly in FIG. 4, the wider portion of the brackets 7,8 is located at least on the end portion of each bracket 7,8 closest to the electrical connectors 9,10. That is, the end of the bracket 7,8 adjacent the electrical connectors 9,10. The point at which the each middle portion meets each wider end portion defines a pair of shoulders 71*a*,72*a* for bracket 7 and 81*a*,82*a* for bracket 8. The shoulders 71*a*,72*a*, 81*a*,82*a* are shaped such that on insertion of the pins 14,15 into their respective brackets 7,8, the point at which the conducting portions 14*a*,14*b* meet the insulating portions 14*b*, 15*b*, abuts the respective shoulder 71*a*,72*a*,81*a*,82*a*. The pins have an increased diameter in the conducting portion 14*a*,14*b* compared to the insulating portion 14*b*,15*b*. This construction prevents the plug 2 being pulled out of the adapter 1 in a direction shown in FIG. 4 even when the adapter 1 is in the open position thus providing improved safety.

The plug 2 is inserted into the adapter 1 when the latter is in the open position. This is achieved by aligning the pins 14,15 of the plug 2 above the brackets 7,8 of the base 3 and sliding the pins 14, 15 down towards the base 3 and into their respective brackets 7,8. The pins 14,15 can only be removed from the adapter 2 by performing the reverse of this process. Accordingly the plug 2 also cannot be removed in this manner when the adapter 1 is in a closed position.

In another embodiment, the electrical connectors 9,10 may each also have a portion (not shown) which acts in combination with the shoulders 71*a*,72*a*,81*a*,82*a* to reinforce the retention of the pins 14,15 of the plug 2. This is achieved by the portion of the electrical connectors 9,10 having a narrow width similar to the width W of the brackets 7,8 and this portion of each electrical connector is received by the respective brackets 7,8. Indeed the width of this portion of the electrical connectors 9,10 may be narrower than the width W but wide enough to accommodate the insulating part 14*b*,15*b* of the pins 14,15. It is therefore apparent that the retention could be provided by this portion of the electrical connectors 9,10 alone if desired.

Furthermore, the narrow portion of the electrical connector 8,9 may be in the form of an IDC (insulation displacement connector) which receives the insulating portion 14*b*,15*b* of the pins 14,15 and may pierce therethrough to contact the conducting portion which is contained within the insulation. The main electrical connection remains by virtue of the connectors 9,10 and the exposed portion of the pins of the plug 2. This also provides retention of the pins 14,15 due to the narrower width of the portion of the electrical connector 9,10.

It will be appreciated that in an alternative embodiment, instead of being limited to inserting the plug into the adapter as described above, the walls of the brackets 7,8 may be resilient such that the plug can be inserted into the adapter by pushing through the opening 16. The resilience of the walls will increase the width of the channels 18*a*,18*b* due to the pushing force by the plug 2 and the curved ends of the pins 14,15 and enable the conducting portions 14*a*,15*a* of the plug 2 to pass through the middle portions of the brackets 7,8. However, the brackets will return to their default position after the conducting portions 14*a*,15*a* have passed and prevent the plug from being retracted in the opposite direction of insertion due to shoulder portions 71*a*,72*a*,81*a*,82*a* of the brackets abutting the points where the conducting portions 14*a*,15*a* meet the insulating portions 14*b*,15*b* of the pins.

A support structure is preferably formed in the base 3 and cover 4 adjacent the opening to support a part 13 of the European type appliance plug 2 when it is connected with the electrical connectors 9,10. In the preferred embodiment the support structure consists of a shaped surface 16 on the inside of base 3 and shaped ribs 17 on the inside of cover 4. The surface and ribs embrace a part 13 of the appliance plug 2 to support the plug 2 when engaged with the converter 1. At least the shaped surface 16 and brackets 7,8 are moulded together to form a single insert which is attached to the base 3.

In one embodiment the enclosure is opened by lifting the cover 4 to expose the electrical connector 9,10 for connection of the appliance plug 2. The plug 2 is inserted in a direction transverse to the direction of its pins into the brackets 7,8 and is retained in this position against an external force acting in a direction opposite to the direction of its pins due to the pins having a reduced diameter portion which is received in the U-shaped guide of the brackets. Once the plug 2 is in position, the hinged cover is closed and screwed tight which brings the projections 20*a*,20*b* on the hinge cover 4 into engagement with the pins of the plug 2 to further ensure that removal of the plug is resisted as might otherwise occur if the plug was lifted and retracted which might result in the pins 14,15 leaving the channels of the brackets 7,8. Furthermore, as the cover 4 is closed the surface 16 and ribs 17 may embrace part 13 of the plug 2 to further prevent loosening or falling out of the plug 2.

It should be appreciated that modifications and alternations obvious to those skilled in the art can be envisaged. For example, the base 3 and cover 4 do not need to be joined by a hinge 5 as shown in the drawings. Instead, they could be separate parts to be assembled by a plurality of screws. Further the adapter 1 is not limited for use with the appliance plug body shape shown in the drawings, and can be used with other shapes of two pin plugs.

The invention claimed is:

1. A plug converter (1) for changing an electrical pin configuration of an appliance plug (2), comprising an enclosure comprising a base (3), a cover (4) for the base (3), and connector pins (6) having a first electrical pin configuration on the base (3) for connecting the plug converter (1) to an electrical outlet, electrical connectors (9,10) within the enclosure for connection with an appliance plug (2) having a second electrical pin configuration, and connected with the connector pins (6) of the converter (1), the electrical connectors being arranged to receive conducting portions (14*a*,15*a*) of the appliance plug (2), and the base comprising pin retention means (7,8) defining a pin receiving channel with a width smaller than the width of the conducting portions of the appliance plug and the pin retention means defines shoulder (71*a*,72*a*, 81*a*,82*a*) adjacent the electrical connectors, the shoulder being shaped such that on insertion of pins of the appliance plug into the pin receiving channel, an edge of the pins where a conducting portion of the pins meet an insulating portion of the pins, is adapted to abut the shoulder in order to resist retraction of the appliance plug from the plug converter in a direction parallel to the axis of the pins but the shoulder allows retraction in a direction transverse to the axis of the pins to maintain the conducting portions of the appliance plug in contact with the electrical connectors.

2. The plug converter of claim 1 wherein the first electrical pin configuration is a three pin configuration.

3. The plug converter of claim 1 wherein the second electrical configuration is a two pin configuration.

4. The plug converter of claim 1 wherein the pin retention means is U-shaped with a width smaller than the diameter of the conducting portions of the pins of the appliance plug but larger than insulating portions of the respective pins of the appliance plug.

5. The plug converter of claim 1 wherein the electrical connectors are formed of a resilient metallic material in order to engage the conducting portions of the pins of the appliance plug.

6. The plug converter of claim 1 wherein the cover comprises at least one projection (20*a*,20*b*) aligned with the electrical connectors on the base when the plug converter is closed.

7. The plug converter of claim 6 wherein the projection is moulded with the cover.

8. The plug converter of claim 1 further comprising an opening in the enclosure and a support structure (16,17) adjacent the opening for supporting the appliance plug.

9. The plug converter of claim 8 wherein the support structure comprises first and second parts on the base and cover respectively that embrace a part of the appliance plug.

10. The plug converter of claim 9 wherein the first and second parts comprise surfaces and/or ribs shaped to embrace a part of the appliance plug.

11. The plug converter of claim 9 wherein the first part is a contoured surface (16) and the second part is shaped ribs (17).

12. The plug converter of claim 9 wherein the first part of the support structure and the pin retention means are moulded into as a single insert which is attached to the base.

13. The plug converter of claim 1 wherein the cover and base are joined by a hinge (5).

14. The plug converter of claim 13 wherein the base (3) and cover (4) pivot open about the hinge (5) for connection of the electrical connectors (9,10) with the appliance plug.

* * * * *